United States Patent [19]

Hubbard

[11] Patent Number: 4,905,716

[45] Date of Patent: Mar. 6, 1990

[54] HOOD FOR PERMANENT WAVE ROD OR CURLER

[76] Inventor: Tom Hubbard, 3319 Pembrook Dr., Sarasota, Fla. 33577

[21] Appl. No.: 256,357

[22] Filed: Apr. 22, 1981

Related U.S. Application Data

[63] Continuation of Ser. No. 69,600, Aug. 24, 1979, abandoned.

[51] Int. Cl.[4] ..... A45D 1/00

[52] U.S. Cl. ..... 132/212; 132/270

[58] Field of Search ..... 132/9; 34/3

[56] References Cited

U.S. PATENT DOCUMENTS

| | | | |
|---|---|---|---|
| 2,232,218 | 2/1941 | Doty | 132/9 UX |
| 2,289,209 | 7/1942 | Reiches | 132/9 |
| 2,510,664 | 6/1950 | Shield | 132/9 |
| 3,802,442 | 4/1974 | Serdar | 132/9 |
| 3,877,471 | 4/1975 | Boyd | 132/9 |
| 4,005,720 | 1/1977 | Machata | 132/9 |

*Primary Examiner*—Richard J. Apley
*Assistant Examiner*—John Welsh

[57] ABSTRACT

A hood generally in the form of a U-shaped channel disposed directly over a strand of hair coiled or wrapped around a permanent wave rod, roller or curler, the hood being provided on its interior side and top walls with a plurality of apertures placed in communication with a source of suction for sucking chemical solutions or water from the hair, or controllably placed in communication with a source of liquid solution or water for impregnating the hair with such liquid solution or water. The hood of the invention may be made open at both ends of the U-shaped channel, or closed by end walls preferably also provided with apertures, or it may be made adjustable in length or adjustable in width such as to adapt itself to any size of permanent wave rods or curlers, or it may be made with appropriate inner interconnections such that a group of apertures acts as spray nozzles and another group of apertures act as suction ports to circulate water or a liquid solution under the hood.

10 Claims, 2 Drawing Sheets

WATER
P

HOOD FOR PERMANENT WAVE ROD OR CURLER

This is a continuation of application Ser. No. 069,600, filed Aug. 24, 1979 now abandoned.

BACKGROUND OF THE INVENTION

The present invention relates to applicators of chemical solutions or water to human hair coiled or wrapped around a permanent wave rod, roller or curler, and more particularly to an elongated hood directly positionable over a permanent wave rod, roller or curler around which a strand of hair is coiled, for withdrawing by suction the chemical solutions or the rinse water impregnating the hair. In the course of applying chemical solutions to hair rolled around a permanent wave rod or hair curler, hair spray devices may be used to direct a spray of water, for rinsing for example, while the chemical solutions or lotions are generally applied directly from a bottle either by hand swabbing or by means of a small spray pump attached to the neck of the bottle. Conventional water spraying devices are generally in the form of a flat plate provided with a plurality of spray aperture nozzles directing water to the top of the rolls of hair, and incapable of directing water at hair proximate the scalp or at hair wrapped on the underside of permanent wave rods or hair curlers.

Some of the problems involved in conventional flat plate hair sprayers have been solved by providing water sprayers in the form of a U-shaped channel, such as disclosed in U.S. Pat. No. 4,005,720, adapted to surround a roll of hair wrapped around a permanent wave rod or curler. However, such devices do not solve the problems involved in removing by conventional means the water impregnating the hair, such as for example by toweling, or the problem of removing from the strands of hair the majority of the chemical solutions prior to rinsing, for example, or the problem of adapting a U-shaped spray nozzle to different lengths of rods or curlers or according to a different diameter of coiled hair resulting from different lengths of strands of hair coiled or wrapped around a rod or curler.

SUMMARY OF THE INVENTION

It is the principal object of the present invention to remedy the shortcomings of the prior art by providing U-shaped channel-like hoods for placing directly over a strand of hair wrapped around a permanent wave rod or hair curler, not only for applying directly to each roll of hair wrapped around a rod or curler chemical solutions and/or rinse water but more particularly for suctioning the liquid impregnating the hair after such liquids have been applied either by means of the hood device of the invention, or by other means such as manual application, and more particularly providing such individual hoods with a width or length adjustment to adapt to diverse sizes of rolled hair, providing hoods with closed end walls, thus completely enclosing a strand of hair rolled around a rod or curler, and further providing a plurality of outlet and inlet apertures on the interior of the hood, such that some of the apertures function as outlet nozzles for applying a liquid to a rolled strand of hair and other apertures function as suction inlet ports for withdrawing liquid from the hair.

These and other objects of the present invention will become apparent to those skilled in the art when the following description of some of the best modes contemplated for practicing the invention is read in conjunction with the accompanying drawing wherein:

DETAILED DESCRIPTION OF THE PREFERRED EMBODIMENTS

Figures 1, 2, 3, 4, 5:
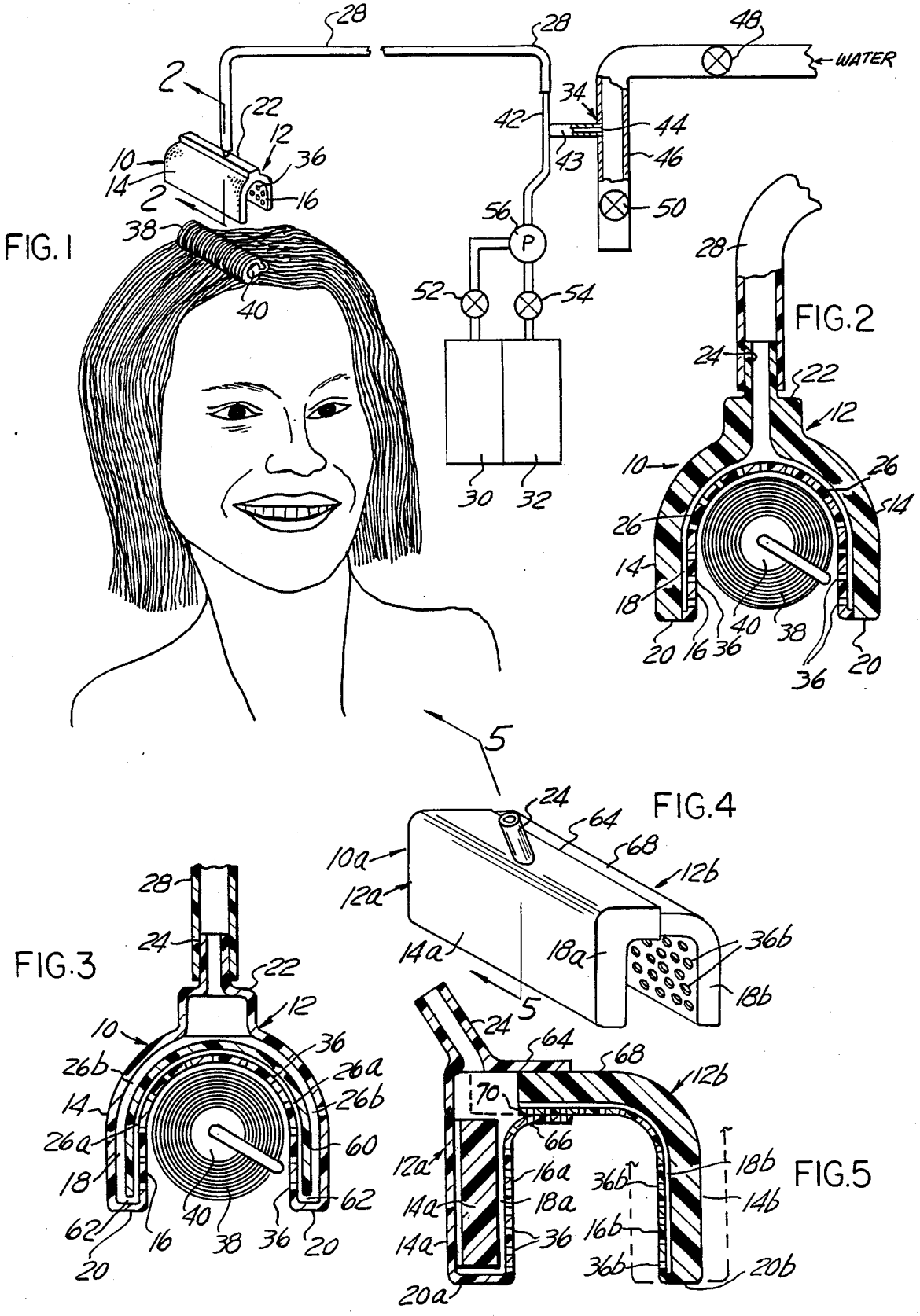
FIG. 1 is a partly perspective and partly schematic view of a hair permanent wave roller or curler individual hood according to the present invention, in its simplest form, and of an applicator and suction system for use of such hood.
FIG. 2 is a section along line 2—2 of FIG. 1.
FIG. 3 is a view similar to FIG. 2, but showing a modification thereof.
FIG. 4 is a perspective view of another modification.
FIG. 5 is a section along line 5—5 of FIG. 4.

Referring now to the drawings, and more particularly to FIGS. 1–2 thereof, a spray and suction hood 10 according to the present invention comprises a generally U-shaped elongated channel member or body 12 which comprises a generally U-shaped channel-like outer wall 14, substantially thick, and a generally U-shaped channel-like inner wall 16, substantially thin, disposed parallel to each other and spaced apart from each other, and forming an elongated hollow body having a U-shaped end wall closures 18 at each end, and an integral slightly rounded bottom wall 20. Preferably, the body 12 is formed with an elongated integral top dome portion 22 provided substantially at its center with a tubular fitting 24 for connection of the internal space 26, defined between the U-shaped inner wall 16, U-shaped external wall 14, the end wall 18 and the bottom wall 20, by means of a flexible hose 28 to one or more sources of liquid solutions, as illustrated schematically at 30 and 32 and to a source of suction and/or rinse water as generally designated by numeral 34. The inner wall 16 is provided with a plurality of apertures 36 disposed in rows as illustrated, or at random from end to end of the inner wall 16 and from one side of the wall 16 to the other. In this manner, when the inner space 26 between the interior wall 16 and the outer wall 14 of the hollow body 12 is connected through the hose 28 to the source of vacuum 34, the body 12 being placed over hair 38 rolled around a permanent wave rod or hair curler 40, the inner wall apertures 36 act as suction inlet ports drawing through the apertures 36 any water or liquid impregnating the roll of hair 38, and drawing the water or liquid through the outlet fitting 24 and the hose 28 to the source of suction or partial vacuum 34.

The source of suction or partial vacuum 34 may be any convenient vacuum pump or, as schematically illustrated, it may consist of a pipe 42 connected to the end of the hose 28 and having a derivation connection 43 terminating in a port 44 disposed in the sidewall of a faucet outlet pipe 46. The faucet outlet pipe 46 has an on-off valve 48 upstream of the port 44 and an on-off valve 50 downstream. When both valves 48 and 50 are open, water flows through the faucet outlet pipe 46, and the flow of water passing by the port 44 creates a suction in the connection 43, the pipe 42 and the hose 28. With the valve 50 closed and the valve 48 open, water is caused to flow through the port 44 and the connection 43 into the pipe 42, the hose 28, into the chamber 26 in the body 12 and through the apertures 36 to rinse the hair 38 rolled around the rod or curler 40.

With the arrangement of FIG. 1, the nozzle and suction hood 10 of the invention may also be used to dispense appropriate chemical solutions from appropriate reservoir such as the reservoirs 30 and 32 of chemical solutions, according to which one of a pair of valves 52 and 54 is closed or open, by means of a pump 56 having its output connected to the pipe 42, or simply by gravity flow, without a pump.

The body 12 of the hood 10 may be made of any convenient material but, preferably, it is made of two plastic moldings, one forming the exterior wall 14 and a portion, or all, of the end walls 18 and the bottom 20, butt welded or otherwise cemented to a shaped or molded plastic sheet forming the inner wall 16 provided with the appropriate apertures 36. The elongated dome portion 22 has no particular function except to provide added rigidity to the body 12.

It will be appreciated that, due to the outer wall 14 of the body 12 being much thicker than the inner wall 16, as illustrated at FIG. 2, the volume of the chamber 26 is relatively small, which substantially improves the suction efficiency through the apertures 36. However, the outer wall 14 may be made with substantially the same thickness as the inner wall 16 and be placed in close proximity therewith. Alternatively, and as illustrated at FIG. 3, the walls 14 and 16 may be disposed substantially apart and be made of the same thickness of material, a U-shaped baffle 60 being disposed between the inner wall 16 and the outer wall 14 of the body 12, thus separating the chamber 26 into two chambers **24*a* and 26*b*, a space or gap 62 separating the interior surface of the bottom wall 20 from each lower edge of the baffle 60. The baffle 60 is supported at its ends by being cemented or otherwise fastened to the end walls 18, such as being molded integrally therewith. The water or solutions suctioned through the apertures 36 into the chamber 26*a* collects above the trough-like bottom walls 20 and is suctioned through the gap 62 and the chamber 26*b***.

According to the present invention, and as illustrated at FIGS. 4–5, a hood **10*a* is made of two hollow body sections 12*a* and 12*b* which are laterally slidably displaceable one relative to the other in order to accommodate various widths of hair rolled around permanent wave rods. As best shown at FIG. 5, the outer wall 14*a* of the body section 12*a* terminates in an integral flange portion 64, while the inner wall 16*a* terminates in an integral flange member portion 66 forming a box-like lip with the flange portion 64 and the end edge of the end walls 18*a*, in which is introduced a straight bridging end portion 68 of the outer wall 14*b* of the hood body section 12*b*, while the perforated inner wall 16*b* terminates with a straight bridging portion 70, the bridging portions 68 and 70 slidably and resiliently fitting in the box-like aperture formed by the flanges 64 and 66 and the end walls 18*a*. The two sections of perforated inner walls 16*a*, and 16*b* are provided with apertures designated respectively at 36*a* and 36*b*, the apertures 36*a* and 38*b* in the upper dome portions of the inner walls 16*a* and 16*b* being arranged such as to mutually register for a given position of the section 12*b* slided into or out of the lateral portion 12*a*, from the extreme positions indicated in phantom line at FIG. 5**.

Figure 6:
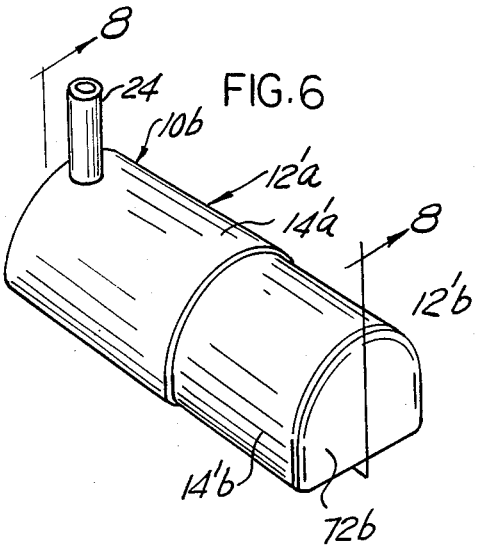
FIGS. 6 and 7 are respectively a top perspective view and a bottom perspective view of a further modification of the invention.
Figure 7:
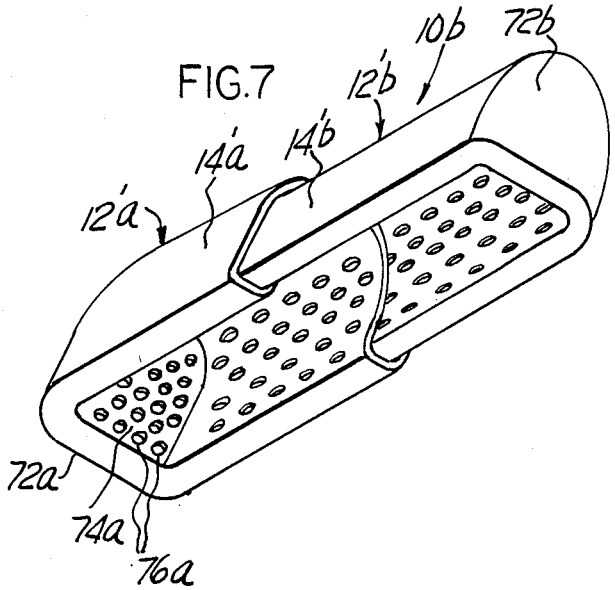
Figure 8:
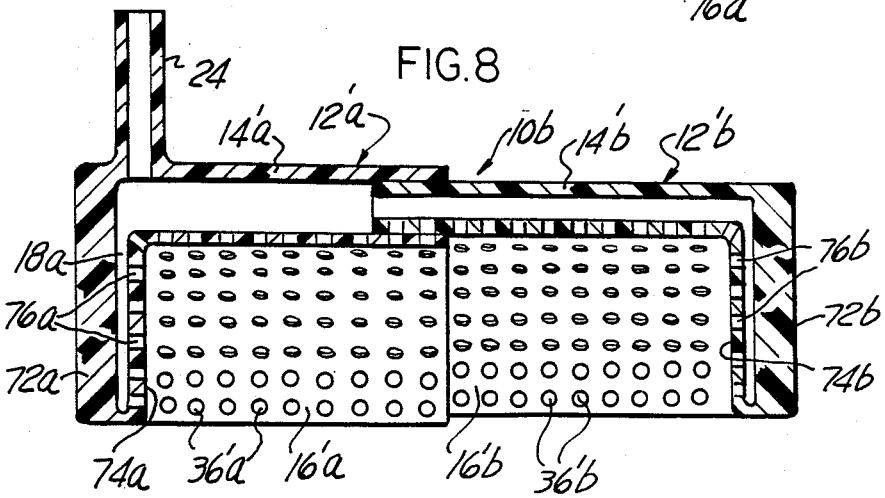
FIG. 8 is a longitudinal section along line 8—8 of FIG. 6.
Figure 9:
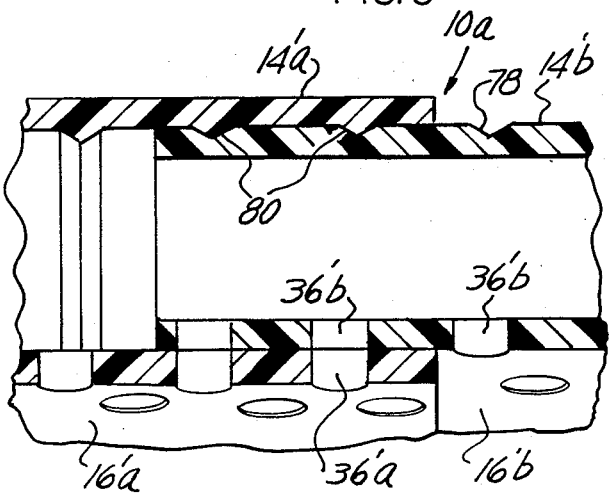
FIG. 9 is a partial view according to FIG. 8 shown at an enlarged scale.

Permanent wave rod or curler hoods according to the present invention can also be made with longitudinally telescopic body portions **12'*a* and 12'*b*, as shown at FIGS. 6–8, each body portion being further provided with a closure end wall 72*a* and 72*b*, respectively, the body portion 12'*b* telescoping within the portion 12'*a*, in the structure illustrated in the drawing. The U-shaped inner wall portion 16'*a* is provided with a plurality of apertures 36'*a*, while the inner wall portion 16'*b* is provided with a plurality of apertures 36'*b*, and the end wall 72*a* and 72*b*, respectively, are provided with integral apertured interior end walls 74*a* and 74*b*, in turn having a plurality of perforations, respectively 76*a* and 76*b*. As best illustrated at FIG. 9, at the junction of the two head body sections, where the section 12'*b* telescopes within the section 12'*a*, at least one of the surfaces in engagement, such as the external surface of the outer wall 14*b*, is provided with a series of regularly spaced shallow serrations or V-grooves 78, and the internal surface of the outer wall 14'*a* is provided with a plurality of regularly spaced ridges 80, or vice-versa, such that when the body portion 12'*b* is pulled from within the body portion 12'*a*, or vice-versa, the two body portions automatically lock through spring back of their walls, with the ridges 80 engaged elastically within the depressions 78 such that the two body sections are secured together and the apertures 34'*b* are aligned with corresponding apertures 36'*a* wherever the perforated inner walls 16'*a* and 16'*b* are superimposed with each other. The distance between the tops of consecutive ridges 80 is evidently equal to the distance between the bottoms of consecutive serrations or grooves 78 and in turn equal to the distance between the centers of consecutive apertures 36'*a* and 36'*b*. A similar arrangement of ridged and grooved surfaces is preferably used in the connection between the two body lateral portions 12*a* and 12*b* of the structure of FIGS. 4–5**.

Figure 10:
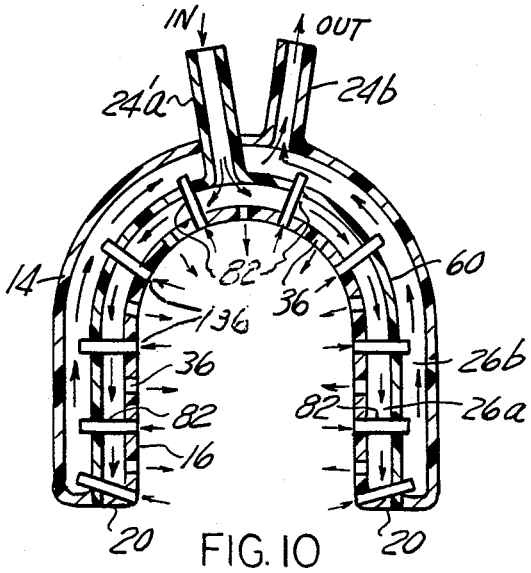
FIG. 10 is a section similar to FIGS. 2, 3 and 5, but showing a further modification thereof.

The generally U-shaped hood of the invention for providing a liquid solution or rinse water, and for suctioning a chemical solution or water from hair rolled around permanent wave rods, may be arranged as illustrated in section at FIG. 10, with the U-shaped centrally disposed baffle 60 extending all the way to the bottom wall portion 20, thus separating the inner chamber into two separate chambers **26*a* and 26*b*. The chamber 26*a* is placed in communication with the exterior of the inner wall 16 by means of the apertures 36 disposed in alternate rows, for example, while alternate rows of apertures, as shown at 136, are connected by means of tubular members 82 to the chamber 26*b*. The chamber 26*b* in turn is placed in communication with a fitting 24*b*, connected by a hose, not shown, for example to a source of suction, while the chamber 26*a* is placed in communication with a fitting 24*a* projecting through the partition wall 60 and connected by means of a hose, not shown, to a source of chemical solution, rinsing water, or the like. In this manner, alternate apertures such as 36 are used to introduce a fluid to rolled hair disposed within the U-shaped channel-like inner wall 16, while alternate apertures 136 are used to withdraw the liquid or to suction the liquid, after the source of liquid has been cut off from the inlet, fitting 24*a***.

Having thus described the present invention by way of examples of structural embodiments thereof, modifications whereof will be apparent to those skilled in the art, what is claimed as new is as follows:

1. A suction hood for placing over hair rolled around a permanent wave rod or curler and for suctioning liquid impregnating said hair, said hood being in the form of a U-shaped elongated channel member comprising a U-shaped outer imperforate wall and a U-shaped inner wall provided with a plurality of apertures substantially over the whole surface of said U-shaped inner wall, said inner wall and outer wall being spaced apart and being connected by bottom walls such as to form therebetween a substantially U-shaped chamber closed at each end by an end wall, conduit means placing said U-shaped chamber in communication with a source of suction, and a U-shaped imperforate surface disposed within said chamber, said surface being closely proximate and parallel to said U-shaped inner wall provided with a plurality of apertures, said U-shaped imperforate internal surface forming a relatively small volume space in said U-shaped chamber in direct communication and close proximity with said apertures in said U-shaped inner wall, said relatively small volume space placing said apertures in communication with said source of suction through said U-shaped chamber and said conduit means, whereby effective suctioning of the liquid through said apertures is accomplished.

2. The hood of claim 1 further comprising an end partition closing each end of said channel member.

3. The hood of claim 2 wherein said end partition comprises a lateral outer imperforate wall integral with said U-shaped outer wall and a lateral inner wall integral with said U-shaped inner wall and provided with a plurality of perforations, said outer and inner lateral walls defining therebetween a chamber in communication with said U-shaped chamber.

4. The hood of claim 1 wherein said surface disposed closely proximate and parallel to said U-shaped inner wall provided with a plurality of apertures is the inner surface of said outer wall.

5. The hood of claim 1 wherein said surface disposed closely proximate and parallel to said U-shaped inner wall provided with a plurality of apertures is a U-shaped baffle member extending longitudinally in said U-shaped chamber.

6. The hood of claim 1 wherein said elongated channel member is formed of two separate U-shaped channel sections, one of said sections being telescopic longitudinally within the other.

7. The hood of claim 2 wherein said elongated channel member is formed of two separate U-shaped channel sections, one of said sections being telescopic longitudinally within the other.

8. The hood of claim 1 wherein said elongated channel member is formed of two separate lateral sections, one of said lateral sections being adjustably displaceable toward the other to vary the width of said U-shaped channel member.

9. The hood of claim 1 wherein said conduit means placing said U-shaped chamber in communication with a source of suction comprises a flexible hose and an appropriate valving arrangement for placing said flexible hose controllably in communication with sources of liquid and said source of suction.

10. The hood of claim 1 further comprising a U-shaped baffle disposed within said U-shaped elongated channel member, said U-shaped baffle separating said U-shaped chamber into two separate chambers, means for placing one of said chambers in communication with a source of liquid, and conduit means placing said one of said chambers in communication with alternate apertures in said U-shaped inner wall.

* * * * *